United States Patent [19]

Paxton et al.

[11] 3,934,917

[45] Jan. 27, 1976

[54] CLAMSHELL BUCKET APPARATUS

[75] Inventors: Curtis L. Paxton; Percy J. Gray, both of Pearland, Tex.

[73] Assignee: McGinnes Manufacturing Company, Pearland, Tex.

[22] Filed: Dec. 10, 1973

[21] Appl. No.: 423,496

[52] U.S. Cl. ..... 294/70; 294/110 R; 37/183 A

[51] Int. Cl.[2] ..... B66C 3/10

[58] Field of Search ..... 294/70, 110 R, 111, 112; 37/183 A, 186; 212/1, 42, 44, 84, 127, 129; 214/147 G

[56] References Cited

UNITED STATES PATENTS

| | | | |
|---|---|---|---|
| 321,158 | 6/1885 | Thompson | 294/110 R |
| 321,159 | 6/1885 | Thompson | 37/186 |

FOREIGN PATENTS OR APPLICATIONS

| | | | |
|---|---|---|---|
| 1,511,023 | 1/1968 | France | 294/110 R |
| 1,205,894 | 9/1970 | United Kingdom | 294/70 |
| 232,230 | 3/1964 | Austria | 294/70 |

*Primary Examiner*—Evon C. Blunk
*Assistant Examiner*—Robert Saifer
*Attorney, Agent, or Firm*—Pravel & Wilson

[57] ABSTRACT

A clamshell bucket apparatus adapted to be suspended from a cable or line which may be used for raising, lowering and operating the bucket for picking up and dumping a load.

18 Claims, 10 Drawing Figures

14
132
71a
14a
71a
F-1
14
71
130
70
70
72
72
131
71b
73
73
71b
71
80
80
81
75
76
81
78
78
73
77
15
15

CLAMSHELL BUCKET APPARATUS

BACKGROUND OF THE INVENTION

The field of this invention is clamshell buckets and the like used for picking up and dumping a load.

Typical of the prior art known to the applicants is found in U.S. Pat. Nos. 866,628; 2,604,709; and 3,547,276. In the earlier two patents which operated with a single line, it was necessary to manually actuate the apparatus for each dumping operation and to re-set same for the next pick-up operation. A lever arm bucket using a single line system has also been used, but so far as is known, no patents issued thereon. U.S. Pat. No. 3,547,276 is believed typical of the prior commercial clamshell bucket apparatus which has a two-line system with one line system being used for raising and lowering the bucket and the other line system being used for manipulating the bucket for dumping and/or picking up a load.

SUMMARY OF THE INVENTION

The present invention relates to a new and improved clamshell bucket apparatus in which the bucket is operable by a single line system for both the raising and lowering of the bucket and the manipulating of the bucket for dumping and picking up a load; the manipulation of the bucket for opening and closing is effected in a very efficient manner with the single line system so that manual re-setting of the bucket for each operation is not required.

DESCRIPTION OF THE PREFERRED EMBODIMENTS

Figure 1:
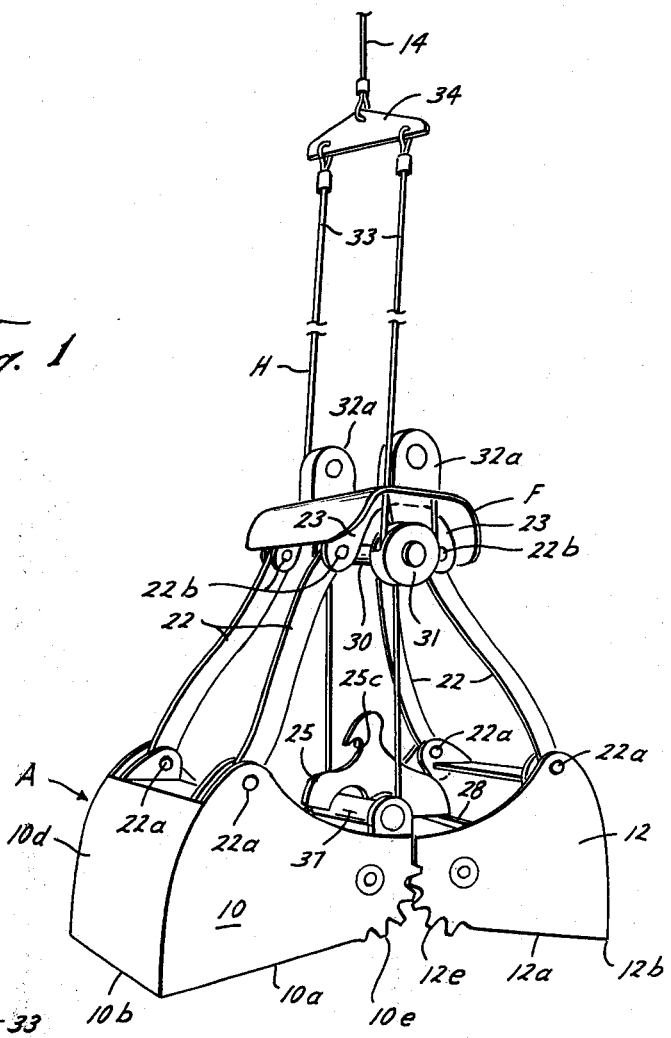
FIG. 1 is an isometric view of one form of the apparatus of this invention with the clamshell bucket sections in the open position as it is being lowered for picking up a load.
Figure 2:
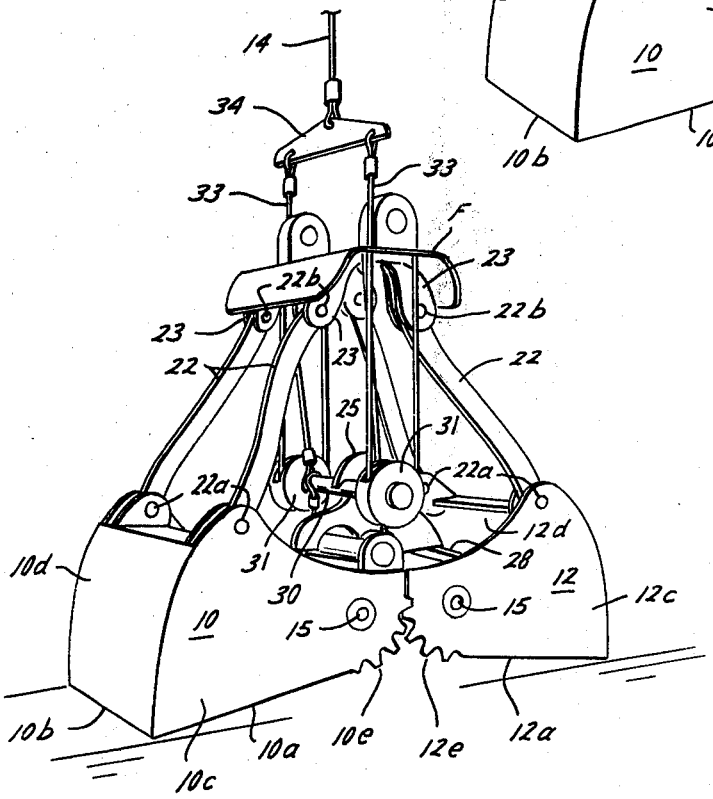
FIG. 2 is a view similar to FIG. 1, but showing the apparatus after it has reached the ground level and the operating line has been lowered to engage the latch mechanism for the beginning of the loading operation, wherein the bucket sections are moved from the open position to a closed position.
Figure 3:
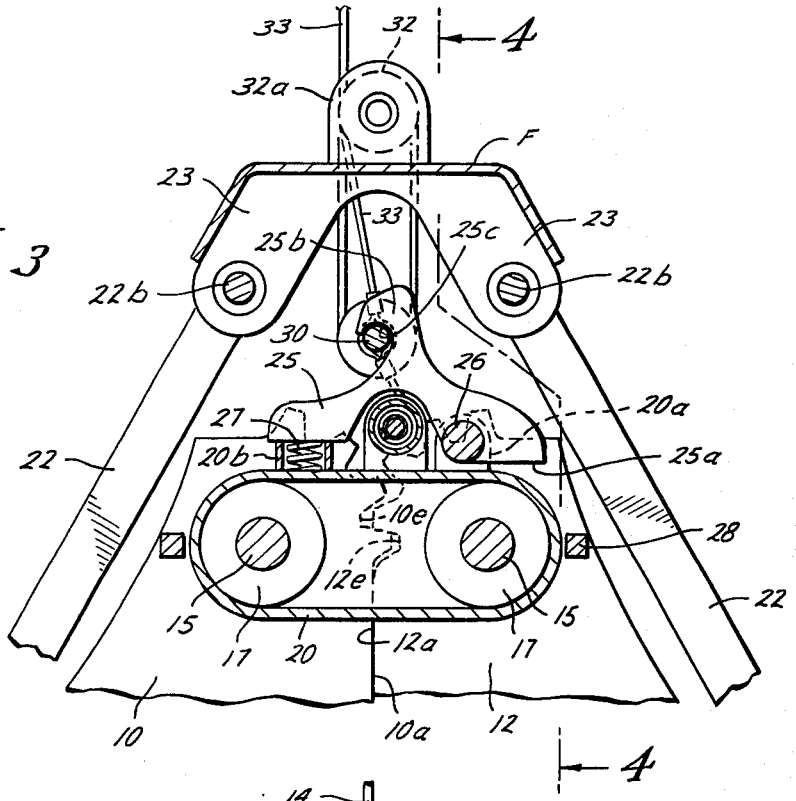
FIG. 3 is a partial view of the apparatus of FIGS. 1 and 2, partly in section, illustrating the upper portion of the apparatus after the bucket sections have been moved to the closed position and have scooped up a load within the section, and with the apparatus then being ready for movement to another location for dumping.
Figure 4:
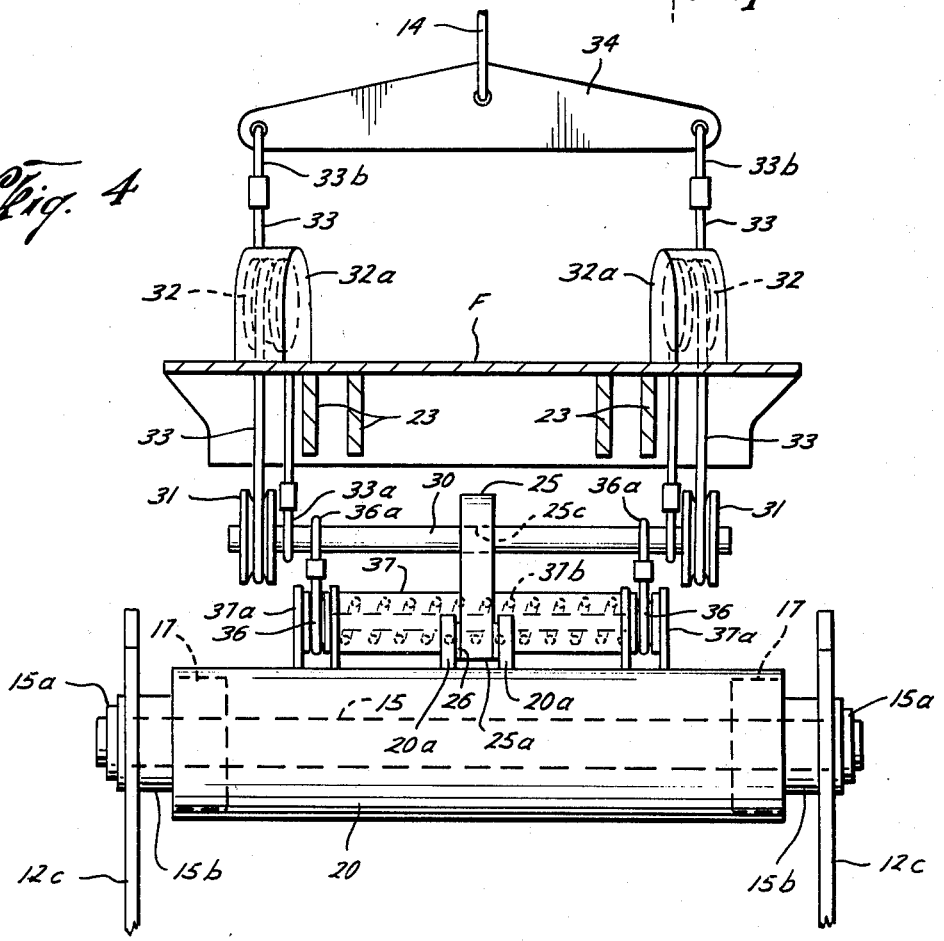
FIG. 4 is a view taken on line 4—4 of FIG. 3 and illustrates the apparatus more in detail.

In the drawings, the letter A designates generally the form of the invention shown in FIGS. 1–4. Such apparatus A broadly includes a pair of clamshell bucket sections 10 and 12 which are essentially duplicates and are disposed opposite each other for operation together, as will be explained. Means are provided, including an upper frame F for mounting the bucket sections 10 and 12 together for pivotal movement to and from the open position (FIGS. 1 and 2) and the closed position (FIG. 3). An operating and hoisting means generally designated with the letter H is operably connected with the clamshell bucket sections 10 and 12, as will be fully explained, for both manipulating the bucket sections to and from the closed and the open positions and for raising and lowering the bucket sections. The operating and hoisting means H specifically includes a single line system which has a single line 14 leading to a crane (not shown) or other operating unit having a winch or conventional means for use with clamshell buckets. The single line 14 to the crane or other operating unit is used without any other line leading to the crane or operating unit. It is not necessary for an operator to manually set the apparatus A of this invention since it is set automatically through manipulation of the apparatus A on the line 14.

Considering the invention more in detail, each of the bucket sections 10 and 12 is formed with a typical scoop configuration having laterally spaced inner edges **10*a* and 12*a*, respectively which are adapted to contact each other in a substantially vertical position when the bucket is in its closed position (FIG. 3), and which are adapted to be extended to a substantially horizontal position when the bucket is in its open position (FIGS. 1 and 2) for picking up or dumping a load. The lower scoop edges 10*b* and 12*b* for the bucket sections 10 and 12, respectively are conventional and serve to scoop up the dirt or other material which is to be picked up and moved with the apparatus A. The sections 10 and 12 also have sides 10*c* and 12*c* which are connected together with a curved bottom plate 10*d* and 12*d*, respectively. Also, preferably interengaging gear teeth 10*e* and 12*e* on the sides 10*c* and 12*c*, respectively, are provided for assuring uniform pivotal movement of the sections 10 and 12**.

Figure 6:
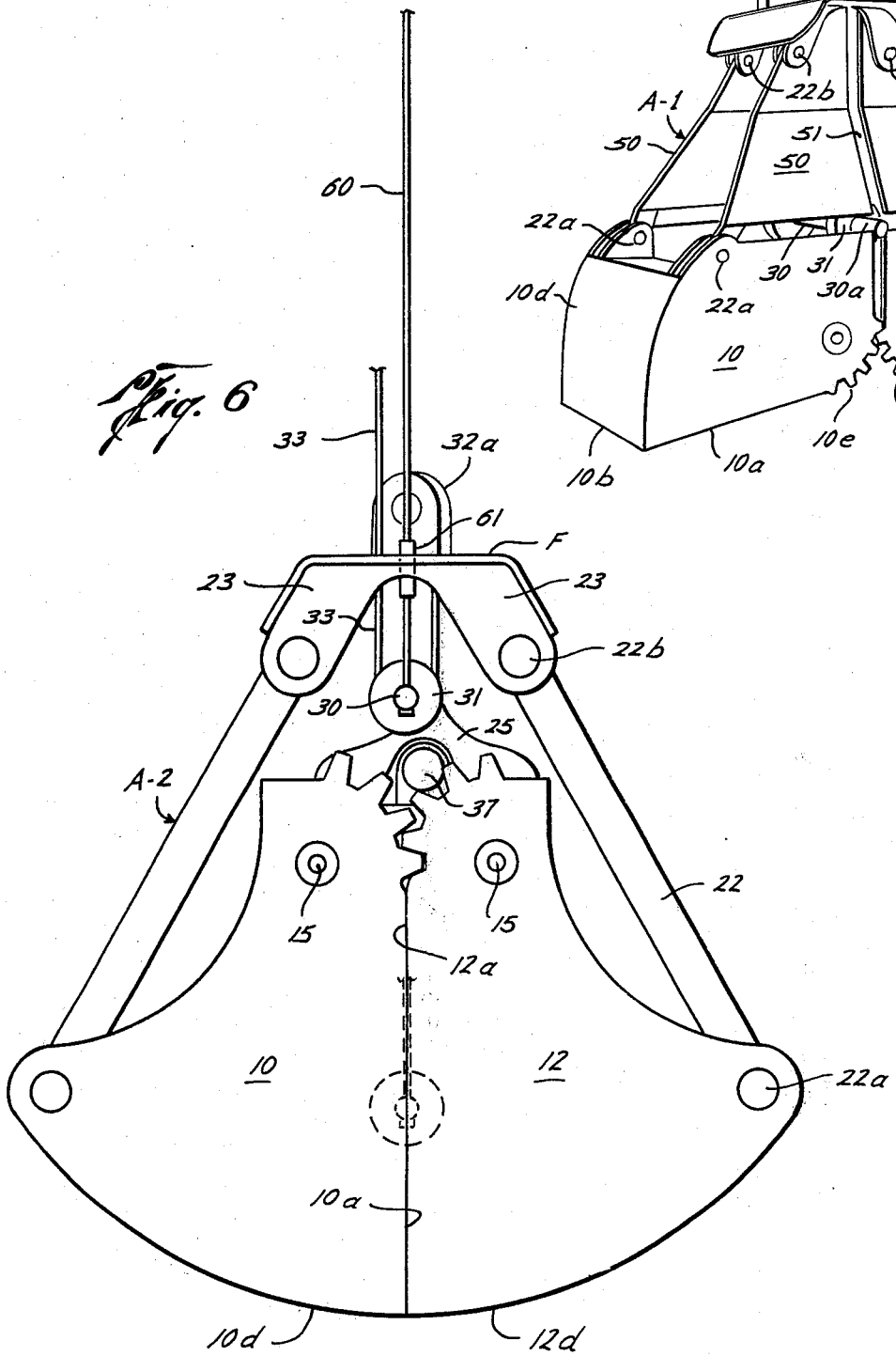
FIG. 6 is a front view of the apparatus of FIGS. 1–4 in the closed position, but showing a modification with respect to the guide means for the latch mechanism.

A pair of laterally extending shafts 15 are disposed parallel to each other, with a shaft 15 going through each of the buckets 10 and 12 for the pivotal movement thereof. The shafts 15 extend through the sides **10*c* and 12*c* as can best be seen in FIG. 4. Each shaft 15 has conventional retaining members 15*a* therewith for maintaining each shaft 15 in position with respect to the sides of the bucket section, and each shaft 15 extends through a bearing or annular support ring 17 (FIGS. 3 and 6). Suitable spacers 15*b* are also preferably provided on each shaft 15, and the bearings 17 for both shafts 15 are enclosed within a shield 20 having an elongate cross-section (FIG. 3**).

The bucket sections 10 and 12 are also connected to the upper frame F by frame links 22 which are pivotally connected by pivot pins **22*a* to the buckets 10 and 12 and are pivotally connected to upper frame members 23 at pivot pins 22*b* (FIG. 3**).

In the form of the invention shown in FIGS. 1–4, a latch member 25 is mounted on a pivot pin 26 which is supported in a suitable pair of brackets **20*a* which are spaced apart laterally and are welded or are otherwise secured to the upper surface of the shield 20. The latch member 25 is urged in a clockwise direction (as viewed in FIG. 3) or towards a released position by means of a spring 27 (FIG. 3) which is preferably confined within a sleeve 20*b* which is welded or is otherwise secured to the upper surface of the shield 20. The sleeve 20b may also serve as a limit or stop for the extent of pivotal movement of the latch member 25 when it is urged towards the latching position, as will be more evident hereinafter. A latch or bar 28 extends laterally between the bucket sides 12*c* and is welded or is otherwise suitably secured thereto for engagement with the lower surface 25*a* of the latch member 25 for urging it to a locked latching position when the bucket sections 10 and 12 are in the open position (FIGS. 1 and 2). When the bucket sections 10 and 12 are in the closed position, the latch lock 28 is displaced away from the surface 25*a* so that the spring 27 can move the latch member 25** to a released position under some conditions, as will be explained.

The latch member 25 preferably has a hook **25*b* at its upper end which has a hook recess 25*c* for engagement with a latching bar 30 under certain conditions, as will be explained. A pulley 31 is mounted at each end of the latching bar 30 for rotation relative thereto, as will be more fully evident hereinafter. A pulley 32 for each of the pulleys 31 is mounted on the upper frame F in a housing 32*a* or other suitable mounting means for rotation and for receiving a portion of a pulley line 33. Each pulley line 33 is secured at one of its ends 33*a* to the latching bar 30 and then it is led around the upper pulley 32 and then downwardly therefrom around the lower pulley 31 and then upwardly through a suitable opening in the frame F so that its other end 33*b* is fastened to a yoke 34. The yoke 34 is connected to the single line 14 which leads to the crane or other operating unit. It should be understood that the term "single line system" as used herein is not limited to a single strand or single line 14 leading to the crane since such line may be multiple strands or a plurality of lines working together, but such term is used to indicate that only a single line system is used for performing both the manipulating of the clamshell bucket apparatus A and for raising and lowering same. In any event, the movements of the line 14 are transmitted through the yoke 34 to both of the lines 33 as shown in FIGS. 1–4.**

A guide means for guiding the latching bar 30 into engagement with the hook recess **25*c* of the latch member 25 includes a pair of guide lines 36 having their upper ends 36a secured to the latching bar 30. The rest of the lines 36 are coiled around a spool 37*a* at the end of a windup mechanism 37 which has a coil spring 37*b* therein exerting a constant force tending to wind the spools 37*a* in a direction to keep the lines 36 wound tightly thereon and pulling the ends 36*a* towards the windup mechanism 37. Thus, the windup mechanism serves to exert a constant pulling force downwardly on the latch member 30 and it also serves to maintain the force uniformly thereon so that the bar 30 does not get cocked appreciably enough to interfere with its entry into the latch member recess 25*c*.**

In the operation or use of the apparatus A shown in FIGS. 1–4, the single line 14 is connected to a crane or other operating unit (not shown) for raising and lowering the clamshell bucket. In the present instance, the line 14 also serves to control the opening and closing of the bucket. Thus, as shown in FIG. 1, the bucket apparatus A is lowered on the line 14 with the bucket sections 10 and 12 in the open position and with the pulleys 31 and the latching member 30 in the upper position in contact with the upper frame F or some portion thereof. Thus, during the lowering of the apparatus A on the line 14, the weight of the apparatus A is supported by the line 14 through the yoke 34 and the pulley line 33 and, by the engagement of the housings on the pulleys 31, or the bar 30 with the upper frame F.

When the bucket sections reach the ground, they are in the position shown in FIG. 2, and by continuing to lower the line 14, the yoke 34 is lowered together with the pulley lines 33 and the pulleys 31. Likewise, the latching member 30 is lowered with the pulleys 31.

During such lowering of the latch bar 30, the guide lines 36 guide the bar 30 downwardly and maintain it substantially horizontal and in position so that when the bar 30 reaches the hook portion **25*b* of the latch member 25, it slides over the forward portion of the hook 25*b* and into the recess 25*c*. It is to be noted that the latch member 25 is in its locked position at that time (FIG. 2) because the lock bar 28 is in contact with the lower surface 25*a* of the latch member 25 and is holding the spring 27 compressed so that the spring cannot act to pivot the latch member 25** in that position.

When the bar 30 has thus automatically slipped into the latch member recess **25*c*, the operator pulls upwardly on the line 14, using the crane or other operating unit attached thereto. The lifting force is then applied to the inner portions of the bucket sections 10 and 12 through the latch member 25, the pivot pin 26, the lugs 20*a*, the shield or housing 20, the hubs or bearings 17 and the shafts 15. As the shafts 15 are thus moved upwardly, the bucket sections pivot about the pivot pins 22*a* and the the interlocking teeth 10*e* and 12*e* mesh with each other and move from the position shown in FIG. 2 to that shown in FIG. 3.**

When the bucket sections 10 and 12 have moved to the closed position of FIG. 3 so that the inner edges **10*a* and 12*a* are substantially in contact with each other and are extending substantially vertically, the weight of the entire apparatus A is supported by the single line 14 and the latching bar 30 is still in the hook recess 25*c* of the latch member 25 so that the latching mechanism cannot be released. Therefore, even though the latch lock 28 has moved away from the surface 25*a* as shown in FIG. 3, the latch member 30 remains in the notch 25*c* and is not released therefrom so long as the weight of the apparatus A is being supported by the line 14.**

When it is desired to dump the load within the bucket, the bucket is moved to a position for dumping and is lowered until the bucket sections 10 and 12 engage the ground and then the line 14 is slackened so as to take the weight of the apparatus from the line 14. When that occurs, the bar 30 is free to move downwardly by its own weight and also by the pull exerted by the spring **37*b* in the windup mechanism 37. When the pulling engagement between the member 30 and the hook 25*b* is thus relaxed, the spring 27 acts to urge the latch member 25 in a clockwise direction as viewed in FIG. 3 so as to move away from the latching member 30, whereby the latching member 30 is disengaged from the latch member 25 so that the latching member 30 may be pulled above the hook portion 25*b* of the latch member 25 by raising the line 14. The line 14 is pulled upwardly to engage the bar 30 and/or the pulleys 31 with the frame or head F, so that further lifting of the line 14 lifts the head F, resulting in the bucket sections 10 and 12 pivoting outwardly from the closed position to the open position (FIG. 1) because the central portions of the buckets are not subjected to the lifting force while the outer portions are lifted at the pivot pins 22***a*.

When the bucket sections 10 and 12 reach the open position shown in FIG. 1, it is to be noted that the latch member 25 is engaged again by the bar 28 so that it has been forced back to the latching position and is ready to be re-engaged by the latching member 30. Therefore, for repeating the above sequence of steps, it is only necessary to lower the line 14 until the latch member 30 re-engages the hook recess 25c and then by lifting upwardly on the line 14, the bucket section 10 and 12 are pulled together to scoop up a load of dirt or other material, as previously explained.

Figure 5:
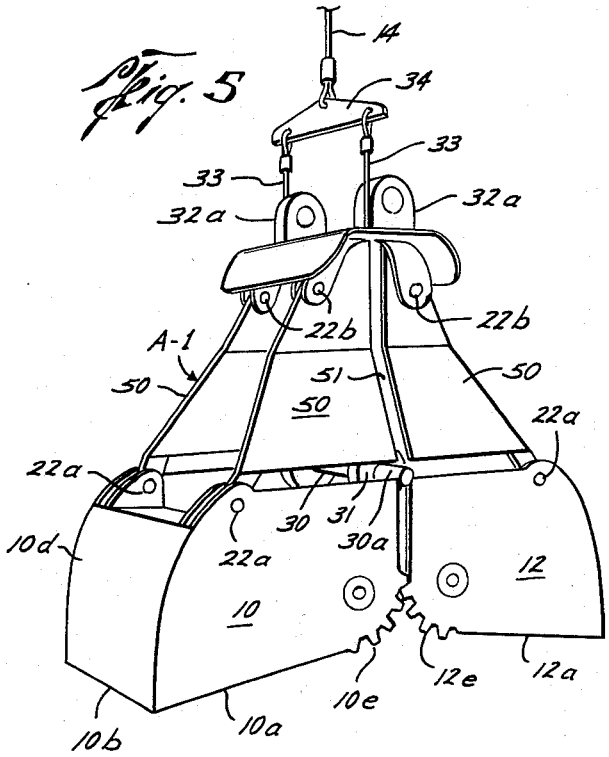
FIG. 5 is an isometric view of a modified form of the apparatus of FIGS. 1–4, wherein a modified guide means is illustrated.

Considering now the form of the invention shown in FIG. 5, wherein the parts thereof which are the same as that shown in FIGS. 1–4 have the same letters and/or numerals, the guide means for the latching member 30 has been modified as compared to that shown in FIGS. 1–4. Thus, the windup mechanism 37 and the guide lines or cables 36 from the rest of the structure therewith have been omitted in FIG. 5 and instead, a plurality of guide plates 50 are connected to pivot pins 22*a* and 22*b* so that such guide plates 50 also take the place of the frame links or arms 22 of FIGS. 1–4. A pair of the plates 50 are on each side of the apparatus A-1 of FIG. 5 and they are spaced apart at the central portion to provide a longitudinal slot 51 through which the ends 30a of the latch bar 30 extend. Thus, the slots 51 serve as a guide track for maintaining the alignment of the latch member 30 in a vertical path as the line 14 is manipulated in the same manner as heretofore described in connection with FIGS. 1–4. Otherwise, the operation and structure of the apparatus of FIG. 5 is the same as that illustrated for FIGS. 1–4. It should be noted that the guide means of FIGS. 1–4 which include the windup mechanism 37 and the guide cables 36 could be also used in conjunction with the guide plates 50 and the guide slots or tracks 51.

FIG. 6 illustrates a modified bucket apparatus A-2 which is similar to that shown in FIGS. 1–4 except that the guide means provided in FIGS. 1–4 has been modified. The parts which are of the same or similar in FIG. 6 to those shown in FIGS. 1–4 have the same numerals and/or letters.

The guide means of the apparatus A-2 is mounted on the outer part of each end of the latching bar 30 and includes a longitudinally extending guide rod 60 made of metal or other similar material which extends through a guide sleeve 61 which is welded or is otherwise secured with the upper frame F. It will be understood that there is a guide rod 60 for each end of the latching member 30, although only one is visible in the view shown in FIG. 6.

In the operation or use of the apparatus A-2, the operation is the same as that heretofore described in connection with FIGS. 1–4, except that the latching member or bar 30 is maintained and is guided in a substantially horizontal position and in a vertical alignment by means of a pair of guide rods 60 which are controlled in their movement as they pass through the guide sleeves 61. Thus, the proper positioning of the latching bar 30 for latching engagement with the hook recess or notch 25c of the latch member 24 is assured.

The windup mechanism 37 is illustrated in FIG. 6 and it may also be used with the guide rods 60 and the guide sleeve 61, but it may be omitted if desired since the windup mechanism 37 and the guide cables 36 are normally not necessary when the guide rods 60 and the guide sleeves 61 are employed.

In FIGS. 7–10, a modified apparatus A-3 is illustrated which is of generally the same configuration and construction as the apparatus A of FIGS. 1–4. The general configuration is slightly modified and additionally, a completely different guide means is employed together with a different hook-up on the operating line.

Thus, the bucket sections 110 and 112 are slightly modified in shape and construction as compared to the bucket sections 10 and 12, but they operate in the same manner and have similar pivotal connection pins 122*a* to the pins 22*a* of FIGS. 1–4. The upper frame F-1 is basically the same although the shape is slightly modified as compared to the shape of the upper frame F. Connecting arms or links 122 correspond with the connecting arms or links 22 of FIGS. 1–4 and they are similarly connected by pivot pins 122*b* to the frame F-1.

Figure 7:
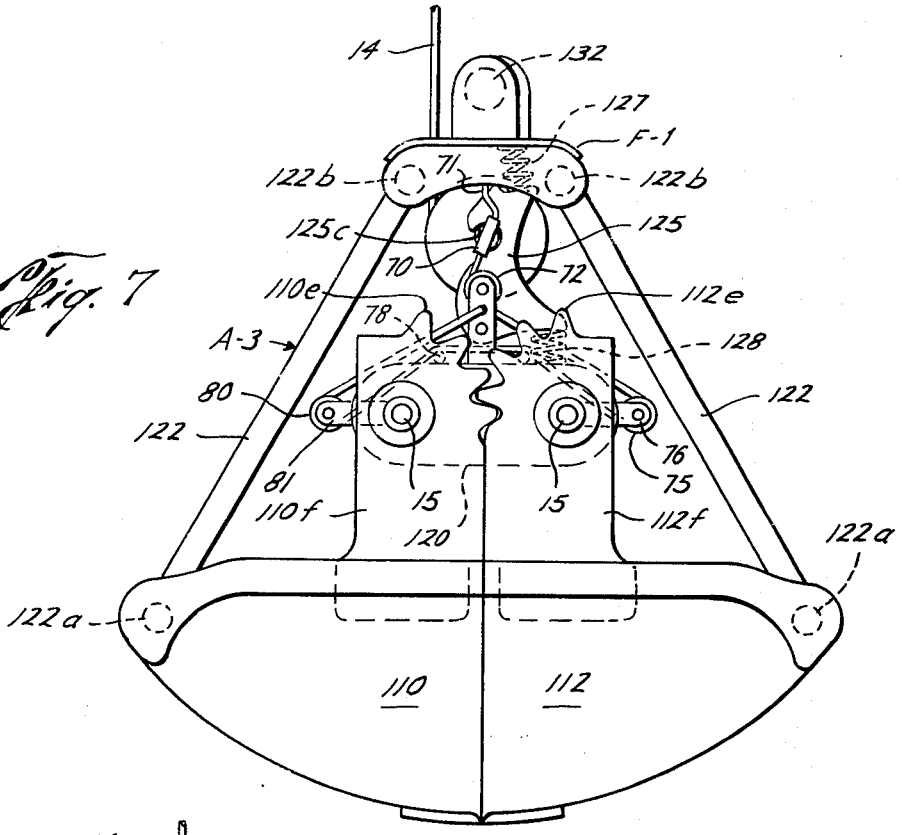
FIG. 7 is a front view of a different form of the invention from that shown in FIGS. 1–6.
Figure 8:
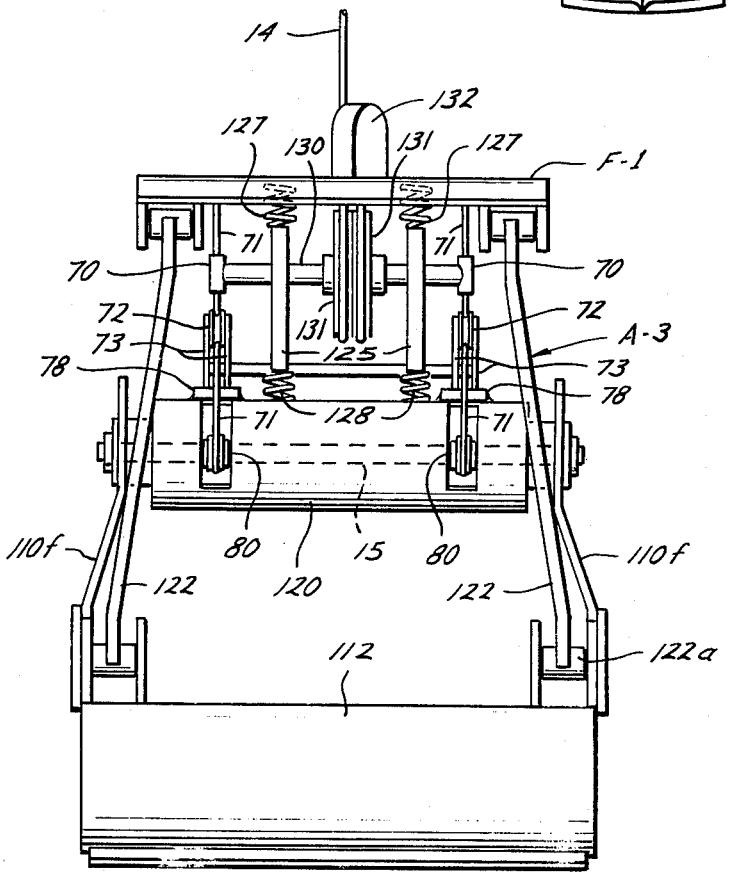
FIG. 8 is a side-view of the apparatus of FIG. 7.

The interlocking teeth 110*e* and 112*e* on the bucket sections 110 and 112 are formed on bucket extensions 110*f* and 112*f*, respectively as illustrated in FIG. 7. The shafts 15 and the shield or housing 120 of FIGS. 7 and 8 are basically the same as that illustrated in FIGS. 1–4 and are similarly mounted for the pivotal movement of the bucket sections 110 and 112 from the closed position of FIGS. 7 and 8 to an open position corresponding to that illustrated in FIGS. 1 and 2. A pair of latch members 125 are preferably employed in the apparatus A-3 rather than the single latch member 25, and each is biased in opposite directions by springs 127 and 128. The springs 127 are normally stronger or are under greater compression than the springs 128 so that the latch members 125 are urged to a released position until the springs 128 are compressed to their maximum extent. When the bucket sections 110 and 112 are in the fully open position such as that of FIG. 7, the springs 128 exert a force on the members 125 so that the latch members 125 are urged to the left to a maximum extent as viewed in FIG. 10, which is the latching position.

The latching member 130 of the apparatus A-3 corresponds to the latching member 30 of FIGS. 1–4 and it has a pair of pulleys 131 mounted at its central portion.

The operating line 14 in the apparatus A-3 is the only line used and it is lead around one of the pulleys 131 and then upwardly around a fixed pulley 132 (FIG. 9) which is mounted on the upper end of the frame F-1. The line 14 is then led downwardly from the pulley 132 and around the other pulley 131 and then upwardly again so that its end 14*a* is fastened in any suitable manner to the frame F-1. Thus, in the apparatus A-3, the line coming from the crane or operating unit is the same line as is fed around the pulleys within the apparatus A-3.

For guiding the latching bar 130 in its vertical travel so that it is assured of engaging within the hook recess 125*c* of each of the latch members 125, a unique guide means is provided which includes a guide sleeve 70 at each end of the latch bar 130. The guide means also includes a guide cable or line 71 for each of the guide sleeves 70 and for ease of description, only one assembly with the guide cable 71 is described hereinafter. Thus, each guide cable 71 has one end 71*a* secured to the upper frame F-1 and then it is led downwardly through the sleeve 70 and around a guide pulley 72 which is mounted on a pair of bracket members 73 which are welded or are otherwise secured to the upper portion of the shield or housing 120.

The line 70 is then led around a guide pulley 75 which is mounted on a pair of arms 76 which are welded or are otherwise secured to the shaft 15 and are movable therewith, as will be more fully explained. The line 71 is led from the pulley 75 to a guide surface or idler roller 77 and then to a similar idler roller or guide surface 78 and then around another guide pulley 80 which is mounted on a pair of brackets 81 which are welded or otherwise secured to the shaft 15 which is extending through the side plates 110*f* (FIG. 7).

Figure 9:
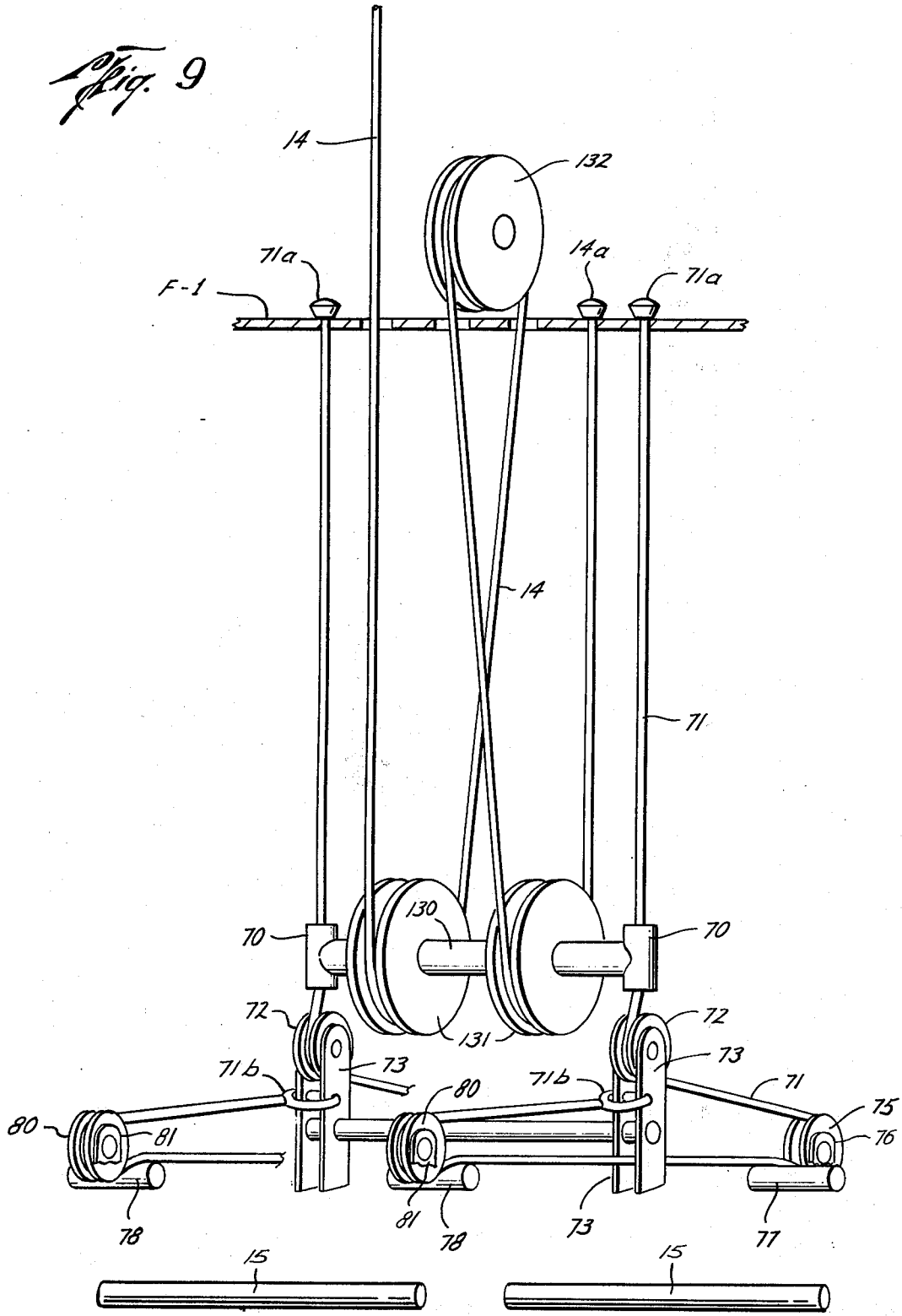
FIG. 9 is a schematic view illustrating the operating line and the control line used with the form of the invention shown in FIGS. 7 and 8.
Figure 10:
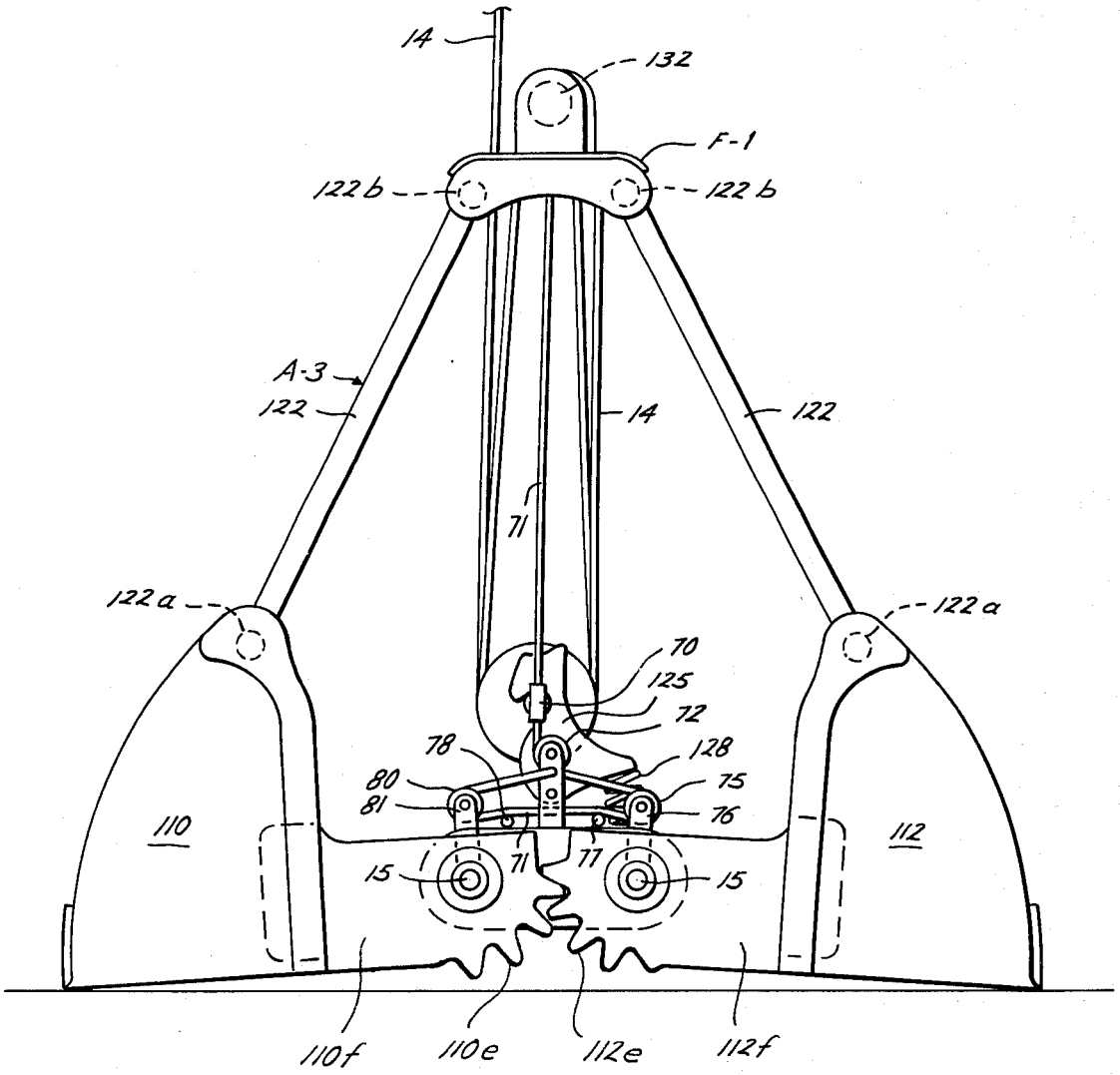
FIG. 10 is an elevation of the modified form of FIGS. 7 and 8, shown in the open position for scooping.

The other end 71*b* of the line 71 is secured to the bracket plates 73 as best seen in FIG. 9.

It is to be noted that the pulley arms 76 and 81 extend substantially horizontally when the bucket sections 110 and 112 are in the closed position (FIG. 7). Under such condition, the line 71 for each of the guide sleeves 70 remains reasonably taut, or at least the slackness in the line 71 does not cause the line to get tangled when the bucket apparatus A-3 is in the closed position shown in FIG. 7.

Since the arms 76 and 81 are fastened to the shafts 15, they pivot upwardly from the horizontal position shown in FIG. 7 to a substantially vertical position when the bucket sections 110 and 112 have moved to the open position corresponding to that shown in FIG. 2. This movement occurs as the upper ends of the bucket sections 110 and 112 move downwardly away from the frame F-1 so that the additional line is made available for spanning the distance from the frame F-1 to the guide pulley 72 at all times even though such distance varies, depending upon whether or not the bucket sections 110 and 112 are in the closed position or in the open position.

In the operation or use of the apparatus A-3, it is essentially the same as that heretofore described in connection with FIGS. 1–4. The latching bar 130 and the pulleys 131 therewith would be in the raised position shown in FIG. 1 and thus would be released from the latch members 125 during the lowering of the apparatus A-3 for picking up a load of dirt or other material. Upon contact with the ground or the material to be picked up, the line 14 would continue to be lowered and would thus be slackened so that the guide sleeves 70 would slide downwardly on the guide lines or cables 71, keeping the latching member 130 in a substantially vertical path and causing it to be guided into the hook portions of the latch members 125, so as to assume the scoop position of FIG. 10.

Thereafter, an upward pull on the line 14 of the apparatus A-3 lifts the center portions of the bucket sections 110 and 112 through the shafts 15, as explained in connection with the apparatus A, causing the bucket sections 110 and 112 to pivot towards each other to the closed position and picking up a load of dirt or other material therewith.

To release the latching mechanism, the bucket sections 110 and 112 are contacted with the ground or other material, and the line 14 is thereafter slackened, so that the springs 127 act to urge the latch members 125 to the released position out of vertical alignment with the latch bar 130 so that thereafter the weight of the members 110 and 112 cause them to further move to the open position where the springs 128 are compressed enough to return the latch members 125 to the latching position. The procedure is then repeated as often as desired.

The foregoing disclosure and description of the invention are illustrative and explanatory thereof, and various changes in the size, shape, and materials as well as in the details of the illustrated construction may be made without departing from the spirit of the invention.

We claim:

1. A clamshell bucket apparatus, comprising:

a pair of clamshell bucket sections each having a scoop configuration with laterally spaced inner edges which are adapted to contact each other in a substantially vertical position when the bucket is in its closed position for lifting a load and are adapted to be extended to a substantially horizontal position when the bucket is in its open position for picking up or dumping a load;

means including an upper frame for pivotally mounting said bucket sections together for pivotal movement to and from said open and closed positions;

operating and hoisting means operably connected with said clamshell bucket sections for both manipulating said bucket sections to and from said closed and open positions and for raising and lowering said bucket sections, said operating and hoisting means including:

a single line system adapted to extend from the clamshell bucket apparatus to a crane or the like;

releasable latch means movably mounted with said bucket sections and automatically biased into the latching position when the bucket sections are open and the single line system is slackened off;

a movable latch-engaging means operably connected with said single line system for movement into engagement with said latch means for thereafter applying a force to said buckets to move same to the closed position by pulling upwardly on said single line system, and for movement out of engagement with said latch means for supporting the entire apparatus from said single line system with the bucket sections in the open position; and means for automatically releasing said latch means from said latch-engaging means by slackening off on said single line system when the bucket sections are supported on the ground or the like.

2. The apparatus set forth in claim 1, including:

means for guiding said latch-engaging means as it moves longitudinally towards and into latched engagement with said latch means.

3. The apparatus set forth in claim 2, wherein said means for guiding said latch-engaging means includes:

means for resiliently urging said latch-engaging means toward said latch means to maintain said latch-engaging means in an engaging position as it approaches said latch means.

4. The apparatus set forth in claim 2, wherein said means for guiding said latch-engaging means includes:

at least one guide rod connected to said latch-engaging means; and a guide sleeve on said upper frame through which said guide rod extends and moves.

5. The apparatus set forth in claim 2, wherein said means for guiding said latch-engaging means includes:

guide plates on the sides of said frame for limiting lateral shifting of said latch-engaging means relative to said latch means.

6. The apparatus set forth in claim 2, wherein said means for guiding said latch-engaging means includes:

a guide sleeve mounted with said latch-engaging means; and a guide line extending through said guide sleeve for guiding said latch-engaging means into engagement with said latch means.

7. The structure set forth in claim 6, including:

means for maintaining said guide line taut at all times as the bucket sections move to and from the open and closed positions.

8. The structure set forth in claim 7, wherein said means for maintaining said guide line taut includes:

a pivoted arm connected to each of said bucket sections for movement therewith, each of which is movable from an upright position to a substantially horizontal position; and said guide line have one end thereof extending from a fixed point on said frame and around both of said pivoted arms for causing said pivoted arms to take up slack in said guide line as the bucket sections pivot from the open to the closed position.

9. The apparatus set forth in claim 1, wherein said single line system includes:

a single line extending from a crane or the like; and a movable pulley supported on a pulley line which line is fixed at one end to said frame and connected at the other end to said single line.

10. The structure set forth in claim 9, wherein said single line system also includes:

a fixed pulley secured on said frame and having said pulley line passing thereover.

11. The apparatus set forth in claim 1, wherein said single line system includes:

a single line extending from a crane or the like; and a movable pulley supported on a pulley line which line is fixed at one end to said frame and connected at the other end to said single line.

12. The apparatus set forth in claim 11, wherein:

said pulley is mounted with and moves with said latch-engaging means.

13. The structure set forth in claim 1, including:

means pivotally mounting said latch means with said bucket sections for vertical movement as said bucket sections pivot to and from the open and closed positions.

14. The structure set forth in claim 13, including:

resilient means urging said latch means to pivot in a direction for releasing same from said latch-engaging means; and latch-locking means engageable with said latch means when said bucket sections are in the closed position for preventing said resilient means from moving said latch means to release same from said latch-engaging means so long as said bucket sections are in the closed position.

15. A clamshell bucket apparatus, comprising:

a pair of clamshell bucket sections each having a scoop configuration with laterally spaced inner edges which are adapted to contact each other in a substantially vertical position when the bucket is in its closed position for lifting a load and are adapted to be extended to a substantially horizontal position when the bucket is in its open position for picking up or dumping a load;

means including an upper frame for pivotally mounting said bucket sections together for pivotal movement to and from said open and closed positions;

operating and hoisting means operably connected with said clamshell bucket sections for both manipulating said bucket sections to and from said closed and open positions and for raising and lowering said bucket sections, said operating and hoisting means including releasable latch means and latch engaging means;

means pivotally mounting said latch means with said bucket sections for vertical movement as said bucket sections pivot to and from the open and closed positions;

resilient means urging said latch means to pivot in a direction for releasing same from said latch-engaging means;

latch locking means engageable with said latch means when said bucket sections are in the closed position for preventing said resilient means from moving said latch means to release same from said latch-engaging means so long as said bucket sections are in the closed position; and said latch locking means is a spring which exerts a great enough force on said latch means to overcome the force of said resilient means only when said bucket sections are in the closed position.

16. The structure set forth in claim 1, wherein:

said latch means is a pivotally mounted hook; and said latch-engaging means is a laterally extending bar adapted to slide over and into engagement with said hook to thereafter prevent separation thereof until the line system is slackened.

17. The structure set forth in claim 1, wherein said single line system includes:

a single line extending from a crane or the like;

a movable pulley supported on said single line;

said line being fastened at one end to said frame and extending through said movable pulley.

18. The structure set forth in claim 17, including:

releasable latch means with said bucket sections; and a longitudinally movable latch-engaging means connected with said movable pulley for movement into engagement with said latch means, and movable away from said latch means when disengaged therefrom by manipulation of said single line for imparting a lifting or supporting of said apparatus.

* * * * *